United States Patent [19]

Dunipace

[11] Patent Number: 5,048,845

[45] Date of Patent: Sep. 17, 1991

[54] ENTRAPMENT ASSEMBLY

[75] Inventor: David B. Dunipace, Fontana, Calif.

[73] Assignee: Innova Champion Discs, Inc., Ontario, Calif.

[21] Appl. No.: 331,268

[22] Filed: Mar. 30, 1989

[51] Int. Cl.[5] ..... A63B 67/06

[52] U.S. Cl. ..... 273/400

[58] Field of Search ..... 273/400; 446/46

[56] References Cited

U.S. PATENT DOCUMENTS

| | | | |
|---|---|---|---|
| D. 45,005 | | Hendryx | D30/115 |
| D. 115,427 | 6/1939 | Schepps | 115/30 |
| D. 260,565 | 9/1981 | Biro et al. | D30/115 |
| 3,831,941 | 8/1974 | Pease | 273/55 D |
| 4,039,189 | 8/1977 | Headrick et al. | 273/400 |
| 4,461,484 | 7/1984 | Headrick | 273/400 |
| 4,568,297 | 2/1986 | Dunipace | 446/46 |
| 4,792,143 | 12/1988 | Headrick | 273/400 |
| 4,809,988 | 3/1989 | Hunter | 273/400 |

OTHER PUBLICATIONS

The file wrapper of U.S. Pat. No. 4,039,189 (Headrick et al.). Issued Aug. 2,1977.

*Primary Examiner*—William H. Grieb
*Attorney, Agent, or Firm*—Lyon & Lyon

[57] ABSTRACT

An entrapment assembly suitable for use as a "hole" in, e.g., a flying disc golf game, is disclosed. The assembly consists of a top portion operatively connected to a nest bottom portion, wherein at least one deflection member is operatively connected to said top portion and descends therefrom to form a "caged" target area for a flying disc or other object. In a preferred embodiment of the assembly, the caged target area is operatively connected to a pedestal and the deflection member or members are a series of tubular shaped impact absorbing members, curved slightly inward, pivotally attached to said top portion and descending into the nest.

33 Claims, 2 Drawing Sheets

ENTRAPMENT ASSEMBLY

BACKGROUND OF THE INVENTION

Publications and other materials used to illuminate the Background, Summary and Detailed Description of the Invention are incorporated herein by reference.

Flying disc golf games have become popular and are enjoying widespread appeal. Such games are played on courses laid out in recreational areas such as parks or college campuses. The course consists of a number of "holes," with each hole having a "tee" from which a flying disc, such as the flying disc disclosed and claimed in U.S. Pat. No. 4,568,297, is thrown by each player, and a post (which serves as the "hole") positioned a selected distance from the tee. As with the traditional game of golf, the objective of the flying disc golf game is to hit the post with a disc with the shortest number of throws of the disc; the player with the lowest score over the entire course is the winner.

In the game, however, visual obstacles such as trees often create frustration for the player in that such obstacles are usually located between the tees and their respective posts. It is therefore necessary to ensure by means other than visual observation that each impact between a disc and post is accurately determined.

Accordingly, flying disc entrapment devices for use in this game and which are designed to capture a disc which impacts a post have been described in the art. Reference is made to U.S. Pat. Nos. 4,039,189 and 4,461,484 for examples of such devices. However, while these devices may perform in accordance with the stated objective of their respective descriptions, these devices are not without limitations and drawbacks that detract from, rather than promote, the amusement value of this game.

For example, the Flying Disc Entrapment Assembly described in U.S. Pat. No. 4,461,484, while designed to be utilized in conjunction with smaller and heavier discs (e.g. 21 centimeters in diameter and about 145 grams in weight), nevertheless does not always capture these discs. Such discs, when thrown, have enough kinetic energy to separate the chains, miss the post and exit through the chains on the other side of the entrapment basket. Additionally, since the chains are gathered at the lower end of the entrapment region, a smaller target area at the lower end thereof is created such that a disc which may become entrapped in the chains if it is aimed at the upper portion of the assembly, may not be entrapped if aimed at the lower portion of the assembly. Furthermore, the assembly disclosed in the aforementioned patent is apparently designed for stationary use such that movement of the assembly from one location to another is not convenient.

SUMMARY OF THE INVENTION

The entrapment assembly of a preferred embodiment of the present invention avoids the problems presented by the prior art by providing an easily assembled, portable device having interchangeable pieces and which provides a true "cage" target. The device of the present invention has at least one deflection member which preferably pivots freely from an upper portion located above the entrapment area, whereby the deflecting member absorbs some of the kinetic energy of an object thrown at the device to impede its forward directional motion and allow it to be captured by the cage. Additionally, since the deflection member preferably hangs in a relatively straight direction and terminates within the nest area of the cage, the entire target area is uniform in size. Preferably, an impact absorbing member is included in the center of said cage to further absorb the kinetic energy of the thrown objects. The nest and top portion of the assembly of the invention are preferably identical in size and shape such that they are interchangeable; a pedestal, also preferably identical in size and shape with said nest and top portion and operatively connected to said nest, is also preferably included as a part of the assembly.

The following drawings of a preferred embodiment of the present invention are set forth merely for illustrative purposes and are not to be construed as limiting or constricting the present invention in any manner. Many variations on the preferred embodiment discussed below will be readily apparent to those skilled in the art and such variations are included in the scope of the invention. For example, a pedestal is not required and the nest and top portion assembly may be suspended from above, or placed directly on the ground, or otherwise supported. Furthermore, the deflection member may cover the entire target region such as, for example, a webbing, which allows for entrance into, but not exit out of, the cage area. Additionally, the present invention can have applicability with respect to a wide variety of objects thrown at the target area, e.g., a tennis ball, a baseball, etc.

DETAILED DESCRIPTION OF THE PREFERRED EMBODIMENT

Figure 1:
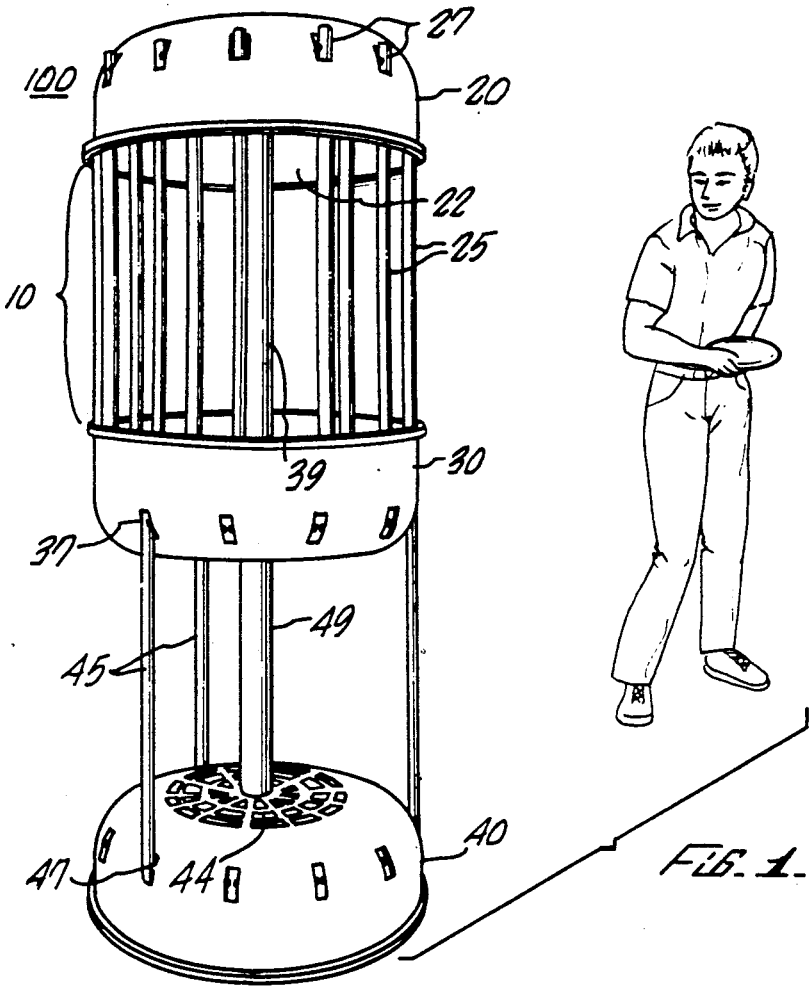
FIG. 1 is a perspective view of the preferred embodiment of the present invention.

The invention will be described with reference to a preferred embodiment set forth in FIG. 1. In that embodiment, a flying disc entrapment assembly 100 is shown relative to an individual poised to toss a flying disc at the central portion 10 of said assembly. Assembly 100 consists of: a domed-shape top portion 20 having a plurality of deflection members 25 attached thereto at regions 27; an upwardly opening nest 30 operatively connected to portion 20 by impact member 39; and a pedestal 40 operatively connected to nest 30 by member 49. Impact member 39 and member 49 may be substituted with any means for connecting portion 20 with nest 30 and nest 30 with pedestal 40. Assembly 100 is further stabilized from leaning or tipping over by stabilizing members 45 which are operatively connected to nest 30 and pedestal 40 at regions 37 and 47, respectively. The interior region 22 of portion 20 is appropriately described as a mirror-image of nest 30, and thus a dome is formed over the interior region 32 of nest 30. Interior region 32 serves as a basket for trapping an object, e.g., a flying disc, thrown at the assembly.

Other embodiments of the present invention may consist of a top portion having any geometric shape operatively connected to a nest portion also having any geometric shape (such as a basket of any suitable geometric shape), whereby a deflection member or members are operatively attached to said top portion and descend toward said nest portion. The geometric shape is a matter of design choice and all operable shapes are included within the scope of the invention. For example, the top portion 20 may be a ring operatively connected to impact member 39. Furthermore, deflection members 25 need not be tubular in shape but must merely function to assist in deflecting the flight path of an object thrown at said device and to "trap" said object within said nest. As an example, a net which flexes inwardly but cannot flex outwardly may be operatively attached to top portion 20; such a net, upon impact by a flying disc, would allow entrance of said disc into the target area but because of the non-outward flexibility of said net, the disc would be entrapped within the cage.

Impact member 39, in addition to connecting portion 20 with nest 30, also preferably absorbs some of the kinetic energy of a disc which contacts such post. Impact member 39 (as well as member 49) is preferably of a tubular shape and made of a flexible material, and most preferably a plastic. However, it is within the scope of the invention to fabricate impact member 39 from any suitable material and in any shape, provided the shape and size does not prevent capturing the object thrown into nest 30. Furthermore, and because impact member 39 is rigidly connected between portion 20 and nest 30, the flight path of an object which contacts post 39 tends to deflect either slightly upwardly or slightly downwardly prior to falling within the interior region 32 of nest 30.

Figure 2:
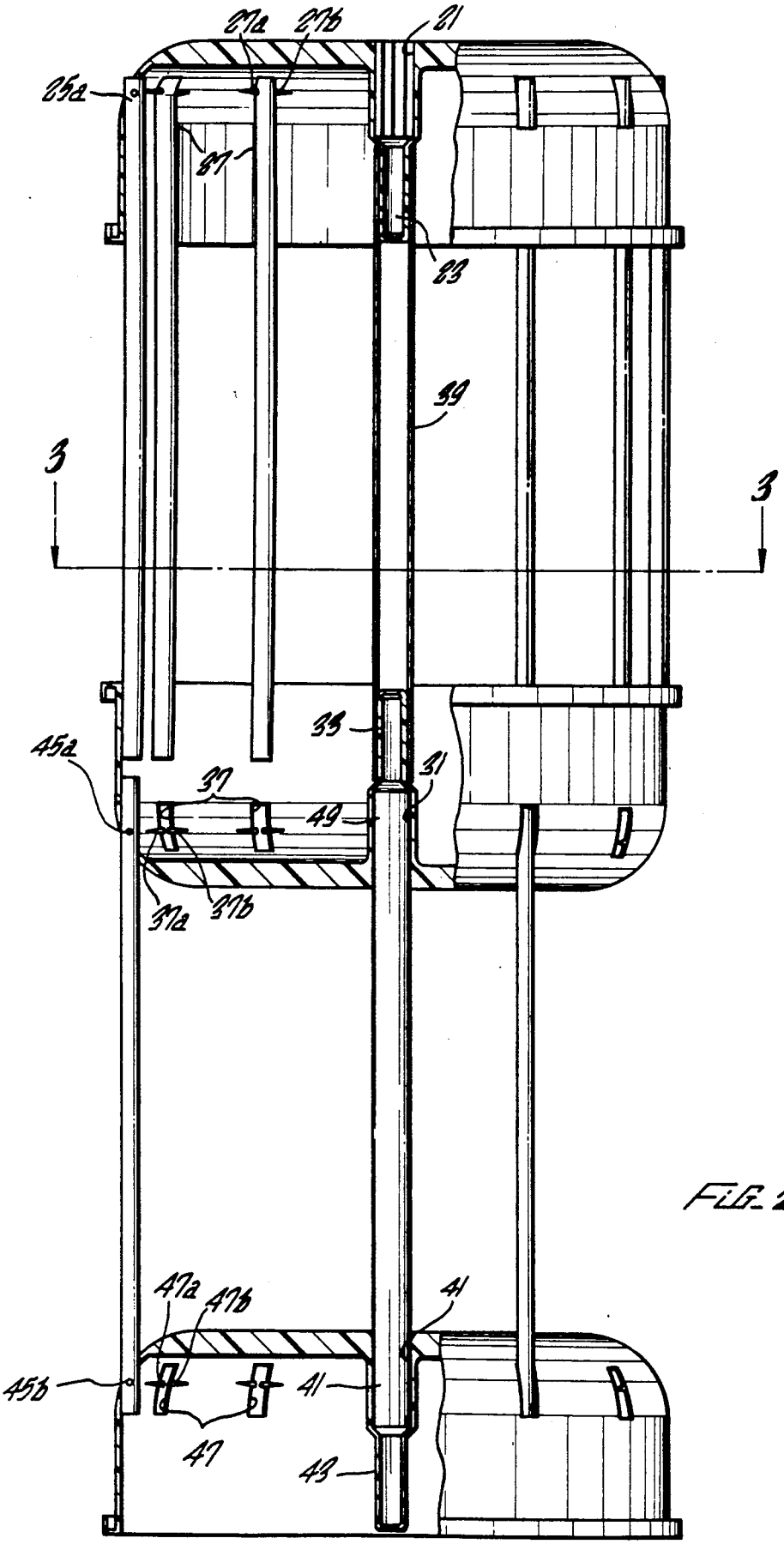
FIG. 2 is a cut-away view of the preferred embodiment shown in FIG. 1.

As shown in FIG. 2, deflection members 25 are preferably tubular in shape and preferably curve slightly inward. Such curvature provides an improved reception for a flying disc hitting such a member, as the curvature can help to deflect the flight path of the disc in a downward direction towards nest 30. Additionally, and because deflection members 25 preferably pivot freely within region 32 of nest 30, a disc thrown at said deflection members and having sufficient kinetic energy will cause deflection members 25 to both pivot inwardly toward post 39 as well as slightly away from one another when contacted by such a disc. In addition to this type of movement of deflection members 25 when a disc initially contacts said members, if such disc does not contact impact member 39 but instead passes through to deflection members opposite to the point of entry, the disc normally does not pass through to the outside of target area 10 since deflection members 25 cannot pivot outwardly because of the location of the lower portion of such deflection members within region 32 of nest 30. Also, and because of the inward curvature of such deflection members, such members will be inclined to "give" in an outwardly direction when contacted by a disc from the interior region of target area 10—in essence, the curvature aids in the absorption of any remaining kinetic energy. Furthermore, and because deflection members 25 (as well as stabilizers 45) are preferably made of a flexible material, and most preferably a plastic, such members additionally absorb some of the kinetic energy of the object which contacts such members.

As further depicted in FIG. 2, deflection members 25 include hole 25*a* extending through member 25. Within such hole fits tab 27*a* on one side and tab 27*b* on the other; thus members 25 pivot freely at this region. Similarly, stabilizing members 45 include holes 45*a* and 45*b* through which tabs 37*a* and 37*b*, and tabs 47*a* and 47*b*, respectively, are inserted. As such, member 45 helps to further stabilize assembly 100.

Portion 20, nest 30 and pedestal 40 all preferably include in the central region thereof inwardly formed regions 21 and 23, 31 and 33, and 41 and 43, respectively. Referencing regions 31 and 33, region 31 is of sufficient diameter to allow for insertion of a portion of post 49 (which is preferably tubular in shape.) Region 33 is of sufficient diameter to fit within a portion of post 39 (which is preferably tubular in shape.)

Figure 3:
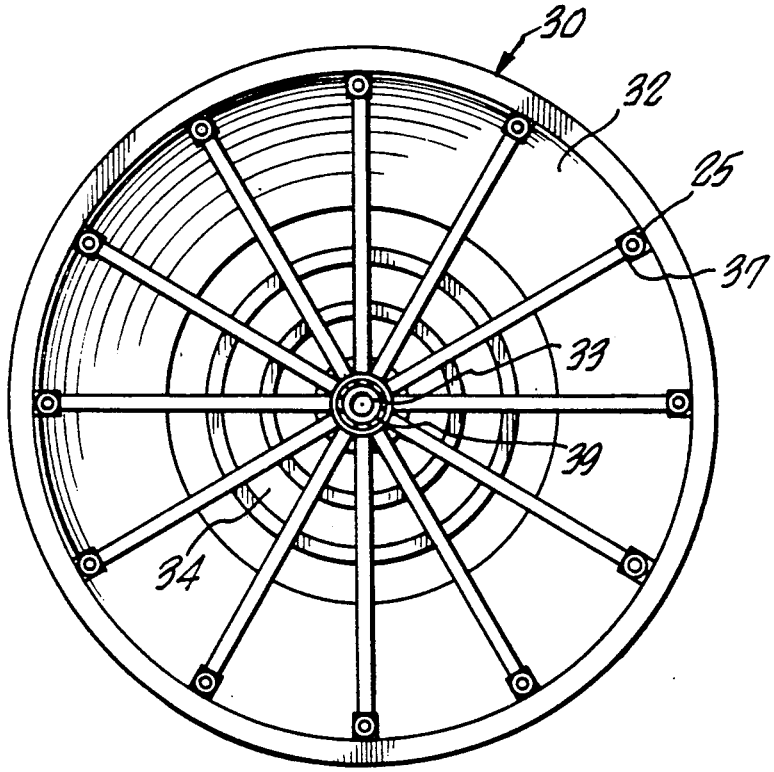
FIG. 3 is a view of the device of FIG. 2 taken through line 3—3.

Top portion 20, nest 30 and pedestal 40 are all preferably made of a sturdy material, and most preferably a plastic. In order to allow for drainage of water and to prevent the wind from causing assembly 100 to tip over, openings, such as those called out generally in FIG. 1 as 44 on pedestal 40, and 34 in FIG. 3, are preferably provided on portion 20, nest 30 and pedestal 40. It is within the scope of the invention to provide a weight assembly (not shown) for use with pedestal 40 to provide greater stability. It is also within the scope of the invention to provide a weight assembly (not shown) for use with nest 30, if the entrapment assembly only consists of a top portion 20 operatively connected to a nest 30, and having at least one deflection member operatively connected to said top portion and descending downwardly therefrom.

Of additional utilitarian benefit to the preferred embodiment of the present invention depicted in the drawings is the interchangeability of many of the pieces of assembly 100. For example, and as can be understood by referring to FIG. 1, top portion 20, nest 30, and pedestal 40 are all approximately the same size and shape and are therefore interchangeable. Post 39 and post 40 are also approximately the same size and shape and are thus interchangeable. Finally, pivotal members 25 and stabilizers 45 are also approximately the same size and shape and thus these too are interchangeable.

Furthermore, since all of the pieces of assembly 100 are most preferably made of a plastic material; assembly 100 is easily transported as an entire unit from one location to another. Additionally, and since the pieces of assembly 100 can be readily separated from another, assembly 100 can be reasonably stored in a compact manner to further facilitate ease of transportation.

Finally, because all of the pieces of assembly 100 are most preferably made of a plastic material, problems associated with rust (as with the chains of the prior art entrapment assembly devices) are avoidable, and ease of cleaning of the device is facilitated.

The foregoing description of the invention is not intended to limit the scope thereof. The full scope of the invention is set forth in the appended claims.

I claim:

1. An entrapment assembly for arresting and trapping an object thrown at said assembly comprising:

(a) a pedestal means for supporting said assembly above the ground;

(b) an upwardly opening nest means for holding said thrown object including means for operatively connecting said pedestal to said nest means, said nest means having a generally basket shape with upwardly extending edge portions;

(c) a downwardly opening and generally domed-shaped top portion including means for operatively connecting said top portion to said nest means; and (d) at least one deflection member operatively connected to said top portion and freely extending downwardly therefrom, wherein at least two of said pedestal means, said nest means and said top portion are substantially interchangeable with each other.

2. The entrapment assembly of claim 1 wherein at least one stabilizing member is operatively connected to said pedestal and said nest.

3. The entrapment assembly of claim 1 wherein said means for operatively connecting said nest to said top portion is an impact absorbing member.

4. The entrapment assembly of claim 3 wherein said impact absorbing member has a tubular shape.

5. The entrapment assembly of claim 1 wherein said means for operatively connecting said pedestal to said nest is a tubular shaped member.

6. The entrapment assembly of claim 1 wherein said nest has a generally circular shape with upwardly extending edge portions.

7. The entrapment assembly of claim 1 wherein said at least one deflection member is a series of tubular shaped members mounted on the outer portion of said top portion and extending downwardly to the interior portion of said nest means.

8. The entrapment assembly of claim 7 wherein said series of tubular shaped members curve inwardly toward the interior region of said assembly.

9. The entrapment assembly of claim 8 wherein said tubular shaped members are of sufficient length to descend within the interior portion of said nest.

10. The entrapment assembly of claim 7 wherein said tubular shaped members are spaced substantially equidistantly from one another around the periphery of said top portion.

11. The entrapment assembly of claim 10 wherein the distance between said tubular shaped members is less than the width of an object to be entrapped in said assembly.

12. The entrapment assembly of claim 1 wherein said object thrown at said assembly is a flying disc.

13. The entrapment assembly of claim 1 wherein said at least one deflection member is of sufficient length to descend within the interior portion of said nest formed by said edge portions.

14. An entrapment assembly for arresting and trapping an object thrown at said assembly comprising:

(a) a pedestal means for supporting said assembly above the ground;

(b) an upwardly opening nest means for holding said thrown object including means for operatively connecting said pedestal to said nest means;

(c) a top portion including means for operatively connecting said top portion to said nest means; and (d) at least one deflection member operatively connected to said top portion and freely extending downwardly therefrom, wherein said means for operatively connecting said nest to said top portion is an impact absorbing member and wherein said nest means further comprises at least one upwardly extending tab portion in the interior region thereof.

15. The entrapment assembly of claim 14 wherein said upwardly extending tab portion is of sufficient size to fit securely within a portion of the internal portion of said impact absorbing member.

16. An entrapment assembly for arresting and trapping an object thrown at said assembly comprising:

(a) a pedestal means for supporting said assembly above the ground;

(b) an upwardly opening nest means for holding said thrown object including means for operatively connecting said pedestal to said nest means;

(c) a top portion including means for operatively connecting said top portion to said nest means; and (d) at least one deflection member operatively connected to said top portion and freely extending downwardly therefrom, wherein said means for operatively connecting said pedestal to said nest is a tubular shaped member and wherein said pedestal further comprises an inwardly formed enclosed region at the central portion thereof.

17. The entrapment assembly of claim 16 wherein said inwardly formed enclosed region is of sufficient size to permit a portion of said upright tubular shaped member to securely engage said nest portion.

18. An entrapment assembly for arresting and trapping an object thrown at said assembly comprising:

(a) a pedestal means for supporting said assembly above the ground;

(b) an upwardly opening nest means for holding said thrown object including means for operatively connecting said pedestal to said nest means;

(c) a top portion including means for operatively connecting said top portion to said nest means; and (d) at least one deflection member operatively connected to said top portion and freely extending downwardly therefrom, wherein said means for operatively connecting said nest to said top portion is an impact absorbing member and wherein said top portion further comprises at least one upwardly extending tab portion in the interior region thereof.

19. The entrapment assembly of claim 18 wherein said downwardly extending tab portion is of sufficient size to fit securely within a portion of the internal portion of said impact absorbing member.

20. An entrapment assembly for arresting and trapping an object thrown at said assembly comprising:

(a) a pedestal means for supporting said assembly above the ground;

(b) an upwardly opening nest means for holding said thrown object including means for operatively connecting said pedestal to said nest means;

(c) a top portion including means for operatively connecting said top portion to said nest means; and (d) at least one deflection member operatively connected to said top portion and freely extending downwardly therefrom, wherein said at least one deflection member is a series of tubular shaped members mounted on the outer portion of said top portion and extending downwardly to the interior portion of the nest means and wherein said top portion further comprises a series of openings spaced substantially equidistantly from one another around the periphery of said top portion.

21. The entrapment assembly of claim 20 wherein said tubular shaped members are pivotally connected to said series of openings.

22. An entrapment assembly for arresting and trapping an object thrown at said assembly comprising:

(a) an upwardly opening nest having a generally basket shaped with upwardly extending edge portions;

(b) a downwardly opening top portion of a generally dome-shape including means for operatively connecting said top portion to said nest, wherein said top portion and said nest are of approximately the same size and shape, and (c) at least one deflection member connected to said top portion and extending downwardly therefrom.

23. The entrapment assembly of claim 22 wherein said at least one deflection member comprises a series of tubular members.

24. The entrapment assembly of claim 23 wherein said tubular members are curved inwardly toward the central region of said assembly.

25. The entrapment assembly of claim 24 wherein said at least one deflection member is of sufficient length to descend into the interior region of said nest.

26. The entrapment assembly of claim 23 wherein said tubular members are of sufficient length to descend into the interior region of said nest.

27. The entrapment assembly of claim 22 wherein said means for operatively connecting said top portion to said nest is an impact absorbing member.

28. The entrapment assembly of claim 27 wherein said impact absorbing member is tubular in shape.

29. The entrapment assembly of claim 22 wherein said assembly further comprises means for supporting said assembly above the ground, said means being an additional member of approximately the same size and shape as said top portion.

30. An entrapment assembly for arresting and trapping an object thrown at said assembly comprising:

(a) a self-supporting pedestal base means for supporting said assembly above the ground;

(b) an upwardly opening nest having a generally circular shape with upwardly extending edge portions and including means for operatively connecting said pedestal to said nest and additional means for stabilizing said assembly;

(c) a top portion including means for operatively connecting said top portion to said nest; and (d) a series of deflection members pivotally connected to the outer peripheral region of said top portion and extending downwardly therefrom and into the interior region of said nest.

31. The entrapment assembly of claim 30 wherein said deflection members are tubular in shape and spaced equidistantly around the periphery of said top portion.

32. An entrapment assembly for arresting and trapping an object thrown at said assembly comprising:

(a) a pedestal;

(b) an upwardly opening nest having a generally circular shape with upwardly extending edge portions and including means for operatively connecting said pedestal to said nest and additional means for stabilizing said assembly;

(c) a top portion including means for operatively connecting said top portion to said means; and (d) a series of deflection members pivotally connected to the outer peripheral region of said top portion and extending downwardly therefrom and into the interior region of said nest, wherein said pedestal, said nest and said top portion are of the same approximate size and shape.

33. The entrapment assembly of claim 32 wherein said means for operatively connecting said pedestal to said nest and said means for operatively connecting said nest to said top portion are tubular members both having the same approximate size and shape.

* * * * *